US006511305B1

(12) United States Patent
Franch

(10) Patent No.: US 6,511,305 B1
(45) **Date of Patent: *Jan. 28, 2003**

(54) OSCILLATORY PUMP-CONVEYOR FOR TRANSPORTING LIQUID-SOLID MIXTURE WITH THE EMPLOYMENT OF ROTATIONAL AND INERTIAL FORCES

(76) Inventor: Gino Franch, Via Col di Lana 5, 1-39100, Bolzano (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/668,975

(22) Filed: Sep. 25, 2000

(30) Foreign Application Priority Data

Oct. 4, 1999 (IT) ..... BZ99A0046

(51) Int. Cl.[7] ..... F04C 21/00

(52) U.S. Cl. ..... 417/481; 417/240; 417/104; 417/211

(58) Field of Search ..... 417/481, 241, 417/93, 99, 394, 379, 461, 240, 104, 211, 437, 92, 94, 95; 92/90

(56) References Cited

U.S. PATENT DOCUMENTS 2,918,875 A * 12/1959 Fisher ..... 103/76
2,948,225 A * 8/1960 Fisher ..... 103/76
3,617,153 A * 11/1971 Mowry ..... 417/241
4,193,743 A * 3/1980 Bille ..... 417/481
4,370,101 A * 1/1983 Vander Horst ..... 417/241
5,524,459 A * 6/1996 Beconcini ..... 66/136
6,305,917 B1 * 10/2001 Franch ..... 417/461

* cited by examiner

*Primary Examiner*—Charles G. Freay
*Assistant Examiner*—Hau L. Liu
(74) *Attorney, Agent, or Firm*—Shlesinger, Fitzsimmons & Shlesinger

(57) ABSTRACT

A biphase conveyor of a mixture of fine solid components with pasty and liquid components based on the use of rotational and periodic inertial forces is described.

In accordance with the present invention the conveyor comprises a mechanism which impresses on the identical rotor pair $R_1$ and $R_2$ a periodic oscillatory motion with identical frequency and with phase other than 90°. The oscillation mechanism can consist indifferently of a connecting rod & crank system or a rotating bearing with eccentric axis between two guides fastened to the rotor. On $R_1$ is rigidly fastened a biphase circuit whose inlet $E_{01}$ is connected with the feeder of the materials to be conveyed and the outlet $U_{01}$ with the inlet $E_{02}$ of an identical biphase circuit fastened on $R_2$ whose outlet $U_{02}$ is connected with the user. All this develops a resultant of continuous inertial forces with constant direction from $E_{01}$ to $U_{02}$ which causes the flow of the materials making up the mixture.

5 Claims, 5 Drawing Sheets

OSCILLATORY PUMP-CONVEYOR FOR TRANSPORTING LIQUID-SOLID MIXTURE WITH THE EMPLOYMENT OF ROTATIONAL AND INERTIAL FORCES

In the present state of the art the conveyance of mixtures of fine solid components with pasty and liquid components is performed (1) by belt conveyor turning on cylinders, which has the disadvantage of a fixed path, limited slope and length and is poorly suited to conveyance of pasty and liquid materials; (2) by bucket conveyor with buckets mounted on endless revolving cords with the disadvantage of a fixed path and uneven flow; and (3) by crane conveyor with revolving arm with range of action limited to the space defined by the length and height of the revolving arm; it has reduced, uneven flow.

The purpose of the present invention is to provide a conveyor of mixtures having any percentage of fine solid components with pasty and liquid components so that the mixture also allows a percentage of 100% of any component.

The conveyor proposed is also suited to broadening and improving the applications of present conveyors as specified below.

This purpose is achieved with a conveyor based on the use of rotational and periodic inertial forces having the characteristics indicated in the characterizing part of claim 1.

The conveyor proposed has the advantage of continuous flow independent of the absolute density of the mass and the percentage of the components of the mixture. It is capable of passing over large height differences and distances. In addition, by using flexible tubes it can easily reach the exact point of arrival of the material. It is suited to the conveyance of solid products such as cereals, sugar, fertilizers and sand, mixtures of products such as concrete mixtures, paste for the manufacture of bread and paper, and poisonous and chemical products whether solid, pasty or liquid, by choosing suitable materials for the tubes. In addition, by using the multipurpose conveyor it is possible to convey simultaneously different mixtures with different flows or different heights and lengths to be overcome, all with high output.

The conveyor which is the object of the present invention application has the same mechanical and circuitry structure as the pump based on rotational inertial forces as set forth in the patent filed with the CCIAA of Bolzano with request no. BZ 98 A 000 035 on Jun. 9, 1998 and the European Office on Mar. 31, 1999 with number 99 201 055.3. FIGS. 1, 2, 3, 4 and 5 of 19 of the latter request are shown here for greater clarity.

Accordingly the function of conveyance of solid, pasty and liquid materials can be considered as an extension of the possible applications of the same machine. The application filed with the European Office can also be useful for clarification of the concepts expressed in this application.

A substantial difference between the two machines lies in the system of feeding of the material to be conveyed in which, as is the case with fine solid materials because of their porousness, feeding the machine can sometimes be done by gravity or, in particular for pasty materials, by an appropriately bladed wheel.

The patent application also includes (a) a special system for transmission of the oscillatory motion of a rotor to another rotor performed by a connecting rod in such a manner that the reaction of the resultant of the inertial force moments generated by each pair of rotors and transmitted to the supporting frame is null, and (b) a special system for subjecting a rotor to an oscillatory and periodic motion. The two systems offer the advantages described below.

The description is set forth in the following paragraphs.

Description of the figures.

Operation of the conveyor.

Transmission through a connecting rod of the oscillatory motion of a rotor to another identical rotor and balancing of the supporting frame of a tetraphase pump.

Oscillatory motion of a rotor generated by a bearing with axis rotating between two guides fastened to the rotor.

Claims.

A. DESCRIPTION OF THE FIGURES

Figure 1:
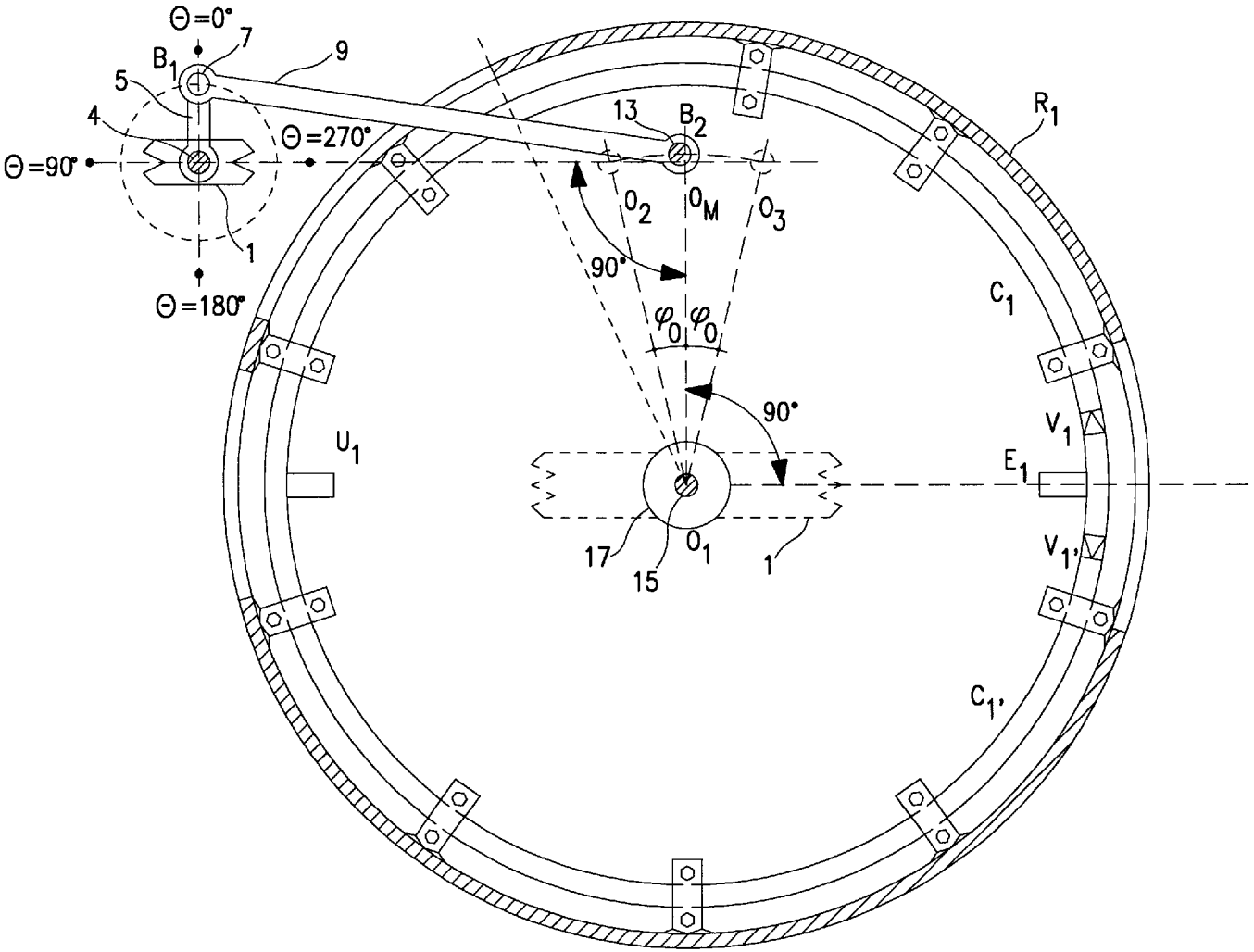

FIG. 1 shows a biphase circuit made up of the parallel of the two active circuits $C_1$ and $C_{1'}$ equipped with the one-way valves $V_1$ and $V_{1'}$. The circuit is fastened to a rotor $R_1$ which is made to oscillate by a connecting rod 9 and crank 5 system. With each 360° rotation of the crank shaft 4 the system causes the two angular travels $+\phi_0$ and $-\phi_0$ of the rotor $R_1$.

Figure 2:
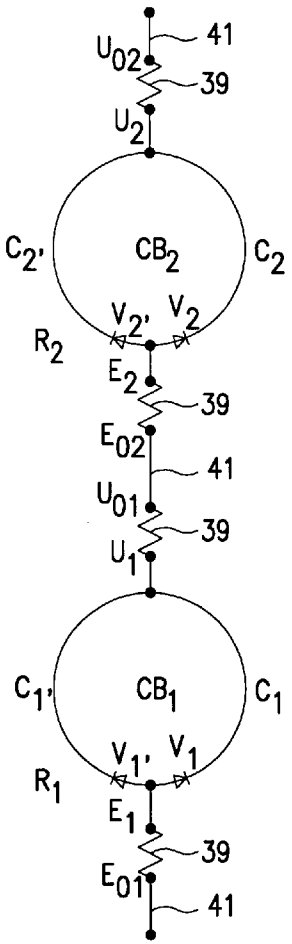

FIG. 2 shows the tubular diagram of a biphase conveyor thus designated because at its inlet there are two active circuits with relative phases 0° and 180°. It consists of the series of two identical biphase circuits $CB_1$ and $CB_2$ fastened to the rotors $R_1$ and $R_2$. The biphase circuits consist of the parallel of the active circuits ($C_1$, $C_{1'}$) and $C_2$, $C_{2'}$). The one-way valves allow therein only the velocity of the material from the inlet $E_1$ of $CB_1$ to the output $U_2$ of $CB_2$. The flexible tubes 39 make possible connection of the movable inlets and outlets of each biphase circuit with the corresponding inlets and outlets fastened to the supporting frame.

Figure 3:
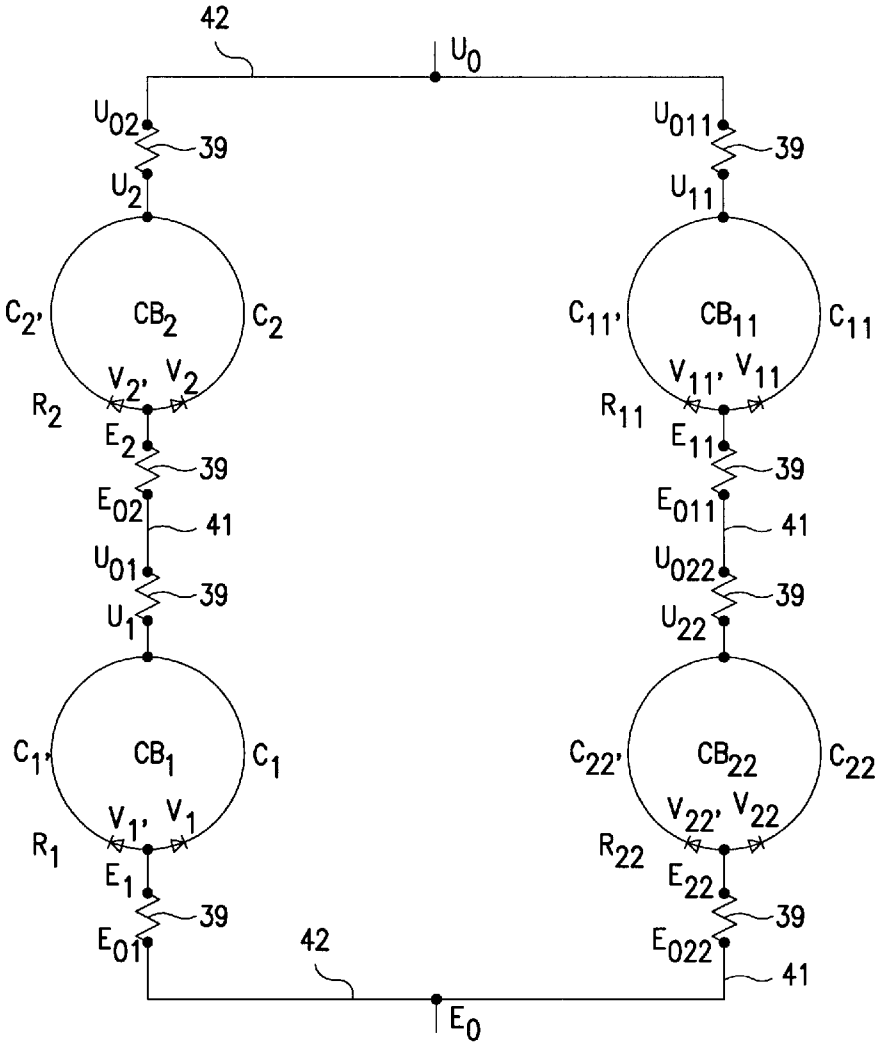

FIG. 3 shows the diagram of the tubular path of a tetraphase material conveyor consisting of the parallel of two biphase conveyors provided in such a manner that at both the inlet and outlet there are four active circuits having relative phase 0°, 90°, 180°, 270°. Accordingly the conveyor is denominated tetraphase. The four phases produce steady behavior of the flow and pressure developed.

Figure 4:
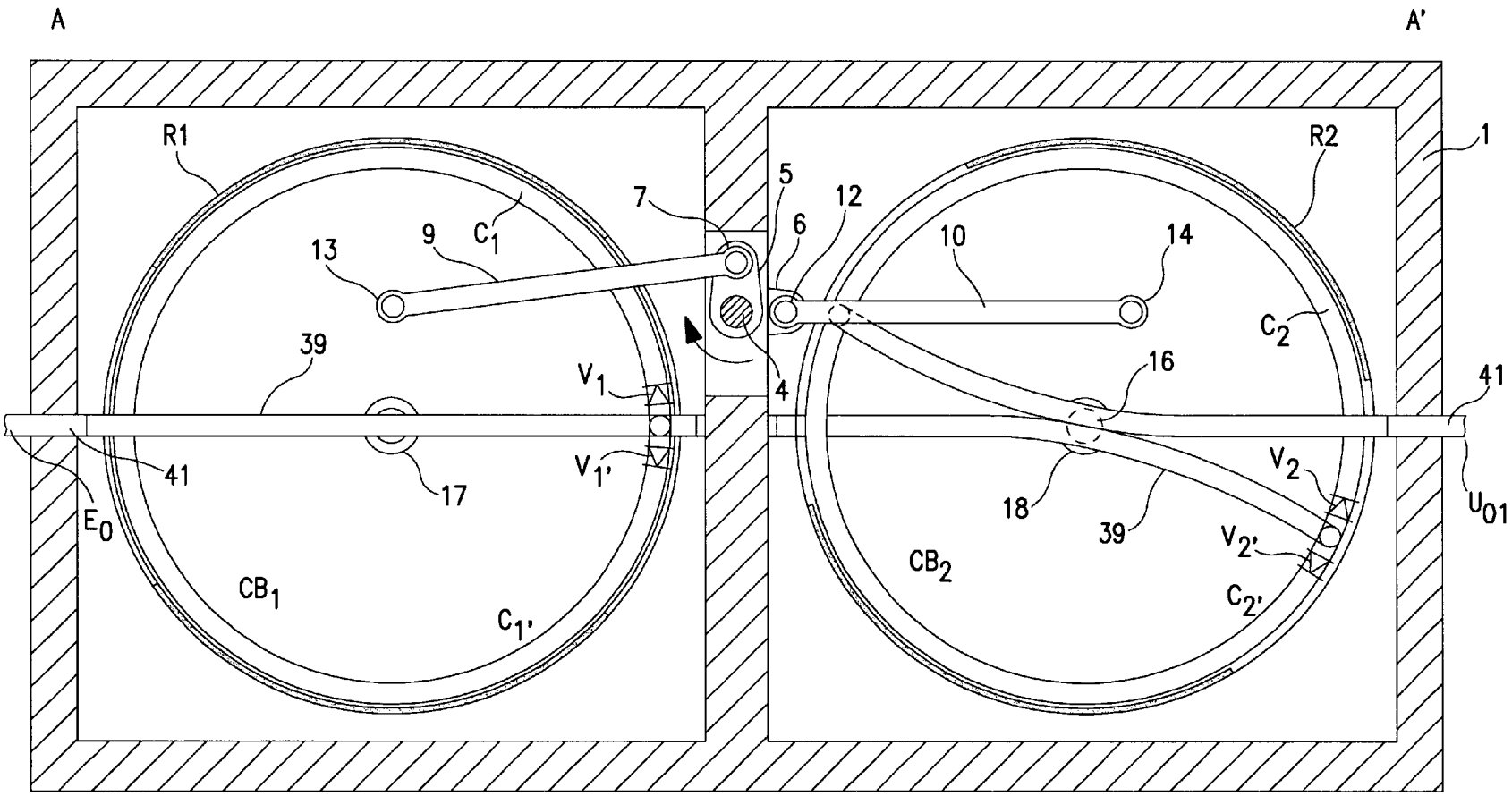

FIG. 4 shows the general diagram of the operation of a biphase conveyor. The diagram is readily interpretable with the aid of FIG. 2 in which all the components are shown. In the FIG. is shown a crankshaft 4 rotating on bearings fastened to the supporting frame 1 which using two cranks 5 and 6 out of phase by 90° and two connecting rods 9, 10 gives the pair of rotors $R_1$ and $R_2$ an oscillatory motion with identical frequency and 90° relative phase. On $R_1$ and $R_2$ are arranged respectively the biphase circuits $CB_1$ and $CB_2$ with the respective active circuits $C_1$ and $C_{1'}$ and $C_2$ and $C_{2'}$ and the corresponding one-way valves $V_1$ and $V_{1'}$ and $V_2$ and $V_{2'}$. The material after the inlet $E_0$ (see also FIG. 2) traverses a rectilinear pipe fitting 41 fastened to the supporting frame, a flexible tube 39, a T fitting (not shown) with stem bent at a right angle, the inlet $E_1$ of $CB_1$ (not shown), the two one-way valves $V_1$ and $V_{1'}$, the circuits $C_1$ and $C_{1'}$, the outlet $U_1$ of $CB_1$ (not shown), a T fitting (not shown) with stem bent at a right angle and a flexible tube (not shown), the rectilinear fitting fastened to the supporting frame (not shown), and a flexible tube 39 bent for rotation of $R_2$, after which, repeating a path identical to that indicated for the $CB_1$ through the components of the $CB_2$ (see also FIG. 2) the material reaches the outlet $U_0$.

Figure 5:
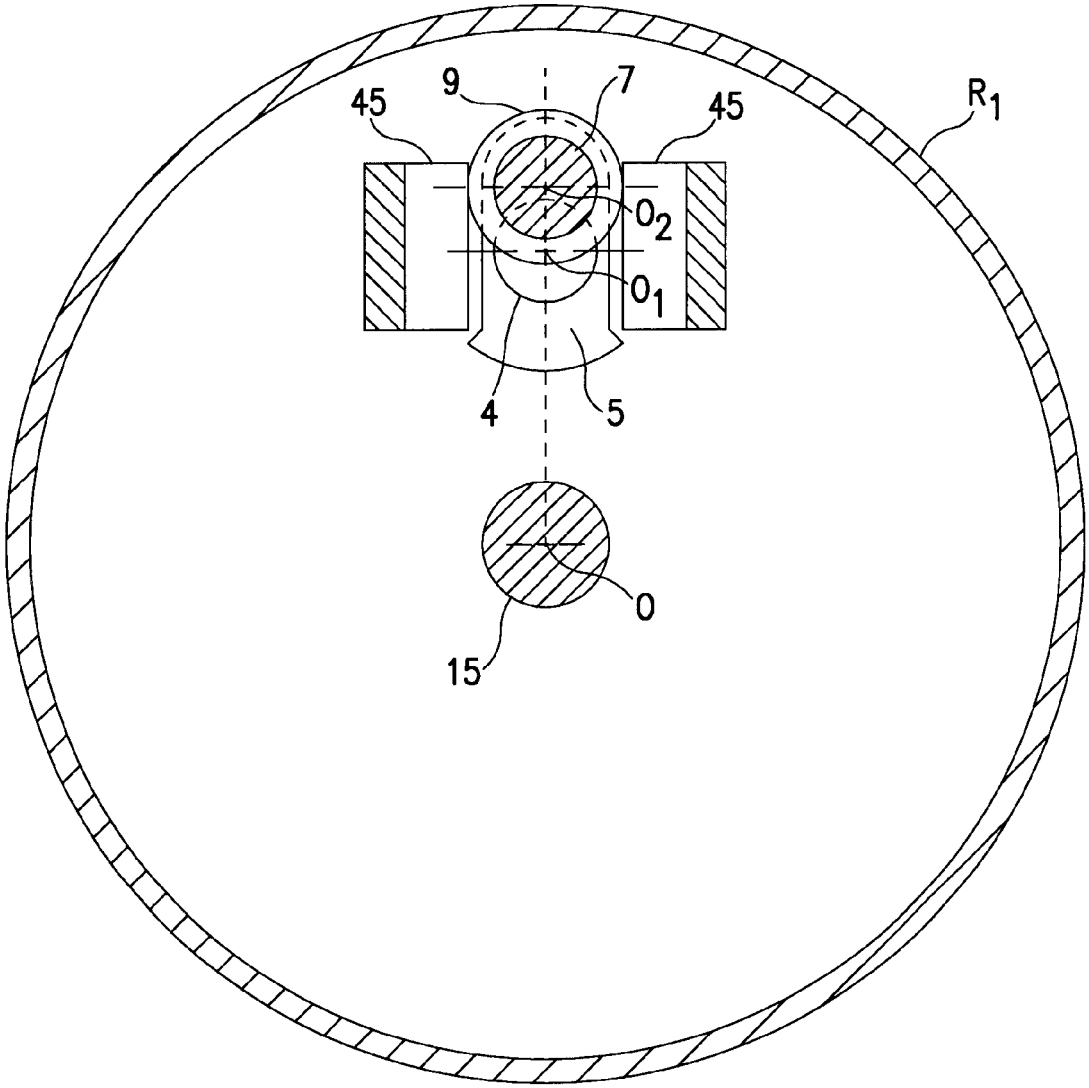

FIG. 5 shows a mechanism designed to convert the rotary motion of the crankshaft 4 into oscillatory motion of the rotor $R_{1'}$ around the shaft 15. Basic details of the mechanism are the crankshaft 4 rotating on bearings fastened to the supporting frame 1 and connected with the motor, the crank 5 on the pin 7 of which is fastened a bearing whose outer ring 9 is arranged between the two guides 45 fastened to the rotor. The angle of oscillation of the rotor $R_1$ around the axis 0–0' is usually relatively small and therefore in this case the crank 5 and the pin 7 can be replaced by a cylinder applied in an eccentric manner to the shaft 4. On the cylinder is arranged a bearing with rotation axis $\mathbf{0}_2$–$\mathbf{0}'_2$ parallel to $\mathbf{0}_1$–$\mathbf{0}'_1$. In this case the angle $\phi^0{}_0$ of maximum rotation of the rotors around 0–0' corresponds to the ratio $\mathbf{0}_1\mathbf{0}_2/\mathbf{00}_1$. The guides are fastened rigidly to the rotor $R_1$ and their internal surfaces belong to two parallel planes equidistant from the rotation axis 0–0' of the rotor and $\mathbf{0}_2$–$\mathbf{0}'_2$ of the bearing. The internal distance of the two guides is equal to the outside diameter of the bearing plus the tolerance necessary so the external ring of the bearing can rotate on a guide independently of the other. In this manner for each rotation of the shaft 4 there is an alternate path of the external ring of the bearing on one of the guides, which causes the oscillatory motion of the rotor $R_1$.

Figure 6:
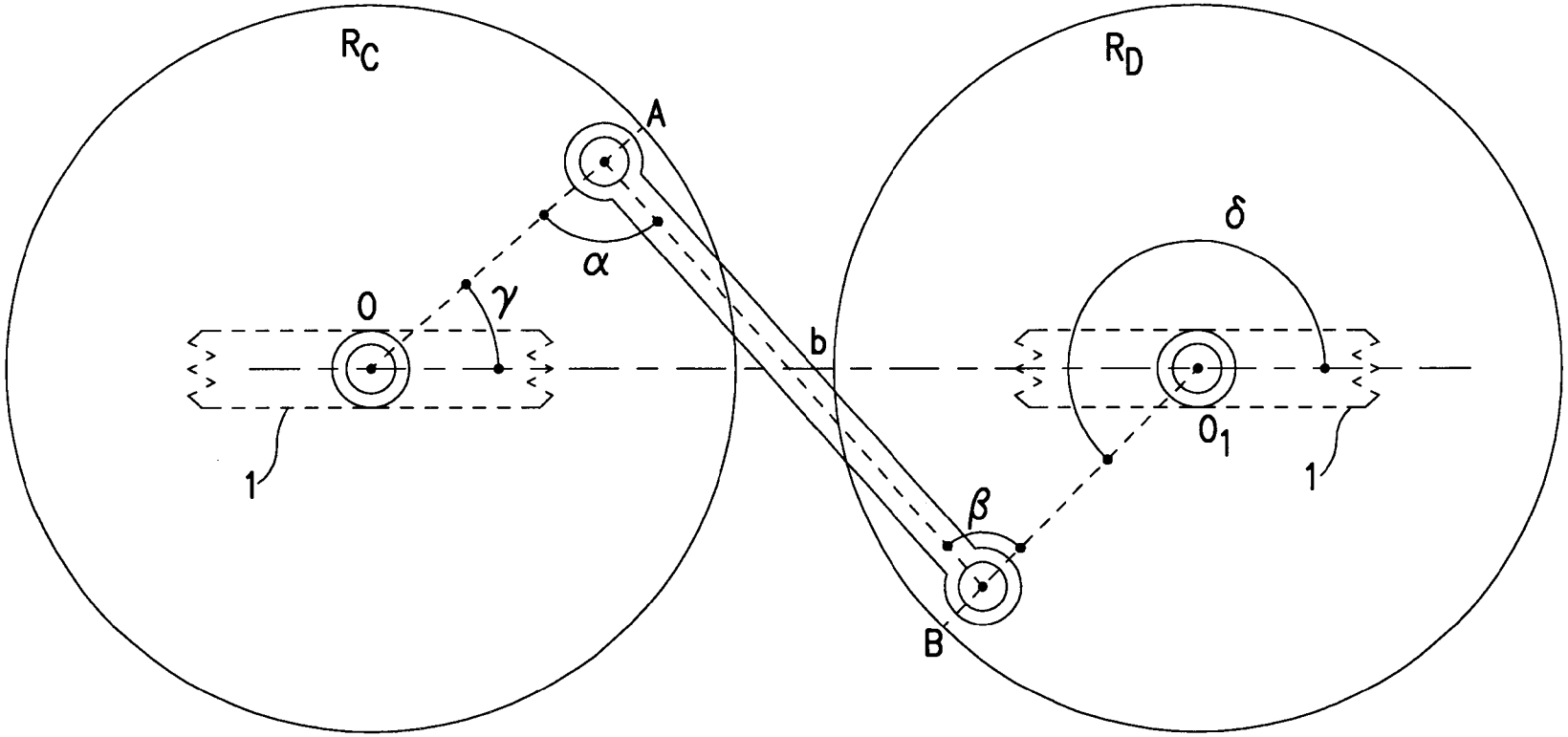

FIG. 6 shows two identical rotors $R_c$ and $R_d$ oscillating with angular velocity in opposite directions around two shafts fastened to the supporting frame 1 and having axes 0–0' and $\mathbf{0}_1$–$\mathbf{0}'_1$ parallel. The rotor $R_c$ is presumed to be subject to an oscillatory motion which is transmitted with rotation direction opposite the rotor $R_d$ to the connecting rod $\overline{AB}$. To each rotor is rigidly applied a pin with axis A–A' and B–B' respectively parallel to the rotation axis. The two pins satisfy the relationship $\overline{AO}=\overline{BO}_1$and in addition the lengths $\overline{AB}$ and $\overline{00}_1$ are fixed so that opposite the angles $\gamma=45°$ of $R_c$ and $\delta=225°$ of $R_D$ the relationships $\alpha=\beta=90°$ where $\alpha$ and $\beta$ are the angles included between the axis $\overline{AB}$ and the axes $\overline{OA}$ and $\overline{O_1B}$. In addition the oscillatory system of $R_c$ is arranged in such a manner that for $\alpha=90$ the rotatory velocity of $R_c$ is the maximum. In this manner $R_c$ and $R_D$ for $\alpha=90$ reach a maximum equal and opposite velocity. In addition the velocity of the rotor pair is canceled at the same time. This satisfies the conditions under which the rotors $R_c$ and $R_D$ will be subjected to an equal and opposite moment of the forces employed for development of their oscillatory motion. Therefore the corresponding reaction transmitted to the supporting frame is null and accordingly balanced.

B. OPERATION OF THE CONVEYOR

The biphase conveyor is considered first. Therein a motor transmits rotatory motion to the crankshaft 4 which by means of a connecting rod & crank or other equivalent system (see FIGS. 1 and 5) impresses on the two identical rotors $R_1$ and $R_2$ a periodic oscillatory motion with identical frequency but with phase other than 90°. The identical biphase circuits $CB_1$ and $CB_2$ are fastened to the rotors $R_1$ and $R_2$ respectively in such a manner that the projection area of each active circuit on a plane $\phi$perpendicular to the rotor rotation axis is maximal and identical.

Under the above specified conditions every material point contained in the active circuits of a biphase circuit is directly subject to an elementary inertial force $df=-r\phi dm=-r\phi\rho dv$ where dm is the elementary mass of the point considered, $\rho$ is its absolute density, dv the elementary volume occupied by dm, r the radius of dm with respect to the rotor rotation axis and $\phi$ the angular acceleration of the rotor. It is inferred that the acceleration and velocity of each component of the mixture are independent of the absolute density and that accordingly in the absence of other forces the mixture will tend to keep its composition unchanged along its path in the conveyor.

In a rotation interval $\theta$ (0°, 180°) of the crank shaft (see FIG. 1) the material contained in the circuit $C_1$ is subject at all points to an inertial force $F_1$ from which it is accelerated in the direction from the inlet $E_1$ to the outlet $U_1$ considered as the positive direction while in the interval $\theta$ (180°, 360°) the force $F_1$ changes sign and tends to cancel the velocity achieved by the material at $\theta$ (0°, 180°). The circuits $C_{1'}$, $C_2$, $C_{2'}$ of FIG. 2 in which the material contained is accelerated in the intervals $\theta$ (180°, 360°), $\theta$ (90°, 270°), $\theta$ (−90°, 90°) and respectively decelerated at $\theta$ (0°, 180°), $\theta$ (−90°, 90°), $\theta$ (90°, 270°) have analogous behaviour.

The material contained in the active circuits of the same biphase circuit is subject at all times to equal and opposite inertial forces. The positive forces with direction from the inlet to the outlet developed in the biphase inlet circuit $CB_1$ are added to the positive forces developed in the biphase outlet circuit $CB_2$ to give a positive useful resultant at all times. The negative forces developed in the two biphase circuits convert the kinetic energy of the material into pressure energy with negligible losses to simultaneously allow continuous motion of the material from the inlet to the outlet of the active circuits and consequently with directional valves continuously open. This is also aided by the atmospheric pressure and kinetic energy of the material contained in the connecting circuits. In the fine solid material conveyor the pumps' characteristic suction ability is reduced. As an alternative a tube is provided in the conveyor in a vertical position at the top of which a filling hopper is arranged. The other end of the tube is placed in series with the inlet $E_0$. This way the force of gravity due to the difference in height between the inlet and outlet of the tube draws the material into the active circuit. With pasty materials a bladed wheel arranged before the $E_0$ inlet is provided. In addition the vertical position of the rotor rotation axis is provided to eliminate any gravitational force component in the active circuits with direction contrary to the motion of the materials. Active circuits in semicircumference, cylindrical spiral and Archimedean spiral form can be used in the conveyor.

The following independent variables are also available: diameter $d_c$ of the active circuits, the number $n_s$ of the turns of the active circuits, the maximum rotation angle $\phi_o$ of the rotors, the radius $r_o$ of the active circuit axis, and the number n of the rotations per second of the crankshaft. Active circuits in semicircumference, cylindrical spiral and Archimedean spiral form can be used in the conveyor. With these variables the conveyor can be sized with exceptional results for any flow and pressure difference and any mixture, even chemical, because suitable material can be chosen for the tubing. The use of a biphase conveyor means that in its operation the reaction of the resultant of the moment of the inertial forces used for development of the oscillatory motion of the two rotors is transmitted to the supporting frame at all times. The supporting frame should therefore be constrained to the supporting base for balance. The problem is solved automatically by employment of the tetraphase conveyor consisting of the parallel of two identical oscillating biphase conveyors with identical frequency and assembled in such a manner that at the inlet and outlet there are four active circuits with relative phase 0°, 90°, 180°, 270°. In this manner a conveyor is provided displaying the following advantages. (a) It has a practically constant flow and pressure; (b) if two rotor pairs with relative phase (0°, 180°) and (90°, 270°) have opposite oscillation velocity, the average value of the reactions of the moments of the forces employed for development of the oscillatory motion of each of the two aforesaid pairs in each half-period of oscillation and transmitted to the supporting frame is null and therefore the supporting frame is automatically balanced; (c) in the tetraphase conveyor the sum of the kinetic energy of the four rotors is constant and therefore flywheel weights are not necessary to control it; (d) the tetraphase conveyor can be provided by arranging the four rotors on a single shaft or by arranging a rotor pair on two distinct parallel shafts; and (e) it is possible to construct a multifunction conveyor equipped with the biphase circuit pairs necessary for simultaneous conveyance of various mixtures with different pressure, flow and chemical characteristics.

C. TRANSMISSION OF THE OSCILLATORY MOTION OF A ROTOR TO ANOTHER IDENTICAL ROTOR BY MEANS OF A CONNECTING ROD AND BALANCING OF THE SUPPORTING FRAME OF A TETRAPHASE CONVEYOR

FIG. 6 specifies the position of the center of rotation O and $O_1$ of the rotors $R_c$ and $R_D$ of points A and B belonging to the axes of the two pins to which the connecting rod is connected and of the lengths $\overline{AB}$ and $\overline{00_1}$, $\overline{OA}$ and $\overline{0_1B}$ which allow simultaneous validity of the relationships $\alpha=\beta=90°$, $\gamma=45°$ and $\delta=225°$. To the rotor $R_c$ is also applied an oscillation mechanism which causes a maximum angular velocity for $\alpha=90°$. For the conditions established the two rotors $R_c$ and $R_D$ for $\alpha=90°$ take on a maximum equal and opposite oscillation velocity. It is also verified that the angular velocities of $R_c$ and $R_D$ cancel each other out simultaneously. It is inferred therefrom that in any semiperiod of the oscillation the average value of the resultant of the moments of the forces employed for the oscillatory motion of each pair of rotors as mentioned above is null. Therefore the corresponding reactions transmitted to the supporting frame are null and the latter is therefore automatically balanced. This result has an important application in a tetraphase conveyor with the following characteristics. (a) Therein there are four identical rotors oscillating with identical frequency and relative phase 0°, 90°, 180°, 270°, (b) the rotors with phase belonging to each pair (0°, 180°) and (90°, 270°) oscillate with opposite velocity on two distinct axes. In this case only two rotors with oscillation phase other than 90° can be subjected to oscillatory motion by one of the above mentioned systems and each pair of rotors with oscillation phase different from 180° can be connected by a connecting rod in the manner described.

After this the conveyor supporting frame subjected in each half-period of oscillation to a null reaction is automatically balanced. As an alternative as mentioned above the four rotors can be individually subjected to oscillatory motion. But this implies a greater number of components, greater space occupied and higher construction and maintenance costs.

D. OSCILLATORY MOTION OF A ROTOR GENERATED BY A BEARING WITH AXIS ROTATING BETWEEN TWO GUIDES FASTENED TO THE ROTOR

See the description for FIG. 5.

What is claimed is:

1. Biphase conveyor of a mixture of fine solid components with pasty and liquid components operating by a series connection of two identical biphase circuits $CB_1$ and $CB_2$ fastened to two rotors $R_1$ and $R_2$ driven by an oscillation mechanism and having a periodic oscillatory motion of the same frequency and relative phase other than 90°, each biphase circuit comprising (a) a curved tube having ends mutually connected to each other and fastened to a rotor; an inlet $E_1$ and an outlet $U_1$ are fastened to the tube, so that the liquid entering through inlet $E_1$ can get to outlet $U_1$ by a left-handed tube section—defined as an active circuit $C_1$—or by a right-handed tube section defined as an active circuit $C_1'$ and arranged in such a way that the positions of the circuits $C_1$ and $C_1'$ on a plane perpendicular to the rotation axis of the rotor are maximum and of identical areas;

(b) a pair of unidirectional valves $V_1$ and $V_1'$ mounted in the tube on the right and on the left of inlet $E_1$ with conduction direction from $E_1$ to $U_1$; the active circuit $C_1$ on the left-handed rotation of the rotor and the active circuit $C_1'$ on a right-handed rotation thereof develop in the liquid contained therein the left-handed rotational inertial force $F_1$ and the right-handed rotation force $F_1'$ respectively, with both of these forces being parallel to the axis of a respective active circuit and having a value increasing from $E_1$ to $U_1$; this justifies the definition "active" assigned to each circuit $C_1$ and $C_1'$; the series connection of the two biphase circuits fastened to the rotors $R_1$ and $R_2$ is made up by connecting the inlet of one circuit to a feeder of the material and the outlet of the other circuit to a discharging tank; in this way, the series of two biphase circuits performs at each instant the summation of the force developed by one circuit $CB_1$ having direction from its inlet to its outlet and with the force developed by $CB_2$ having direction from the inlet to the outlet of the other circuit; the result causing the flow of the mixture and characterized in that on its rotors are fastened the circuits designed to convey simultaneously by means of a single mechanical part more than one mixture of fine solid components with pasty and liquid components having different flows and pressure.

2. Biphase conveyor according to claim 1, characterized in that active circuits in semicircumference, cylindrical spiral and Archimedean Spiral form are used in the conveyor for development of the inertial forces.

3. Biphase conveyor according to claim 1, characterized in that for the oscillatory motion of the rotors there is used a mechanism consisting of: a) a crankshaft on whose crank pin is applied a bearing; b) two parallel guides fastened to the rotor in a symmetrical position with respect to its rotation axis which comprise the external ring of the bearing to be able to transmit to the rotor an oscillatory motion causing the crankshaft to rotate.

4. Tetraphase conveyor according to claim 1, characterized in that it consists of the parallel of two identical biphase conveyors with rotors oscillating at the same frequency on a single shaft or on two parallel shafts with the biphase circuits being connected in such a manner that at the inlet and outlet of the conveyor there are four active circuits with oscillation phase 0°, 90°, 180°, 270° and in addition the two pairs of rotors with relative phase other than 180° have equal and opposite oscillation velocity with the resultant tetraphase conveyor or thereby producing a) development of practically constant flow and pressure of each mixture; b) automatic balance of a supporting frame in every half period of oscillation with respect to the reactions of the moments of the forces employed for the rotor oscillatory motion; c) steadiness of the sum of the kinetic energy of the four rotors and therefore absence of flywheel masses for regulation; and d) the capability by the addition of the associated active circuits to provide a multifunctional tetraphase conveyor.

5. Tetraphase conveyor according to claim 1, characterized by: 1) two pairs of identical rotors oscillating at the same frequency on two distinct parallel axes with relative phase of 180°, 2) only one rotor of each pair thereof is subjected to oscillatory motion and said one rotor using a connecting rod transmits to the others rotor of the same pair of an oscillatory motion with opposite direction in such a manner that the average value of the reaction caused by the development of the oscillatory motion of each rotor pair and transmitted to a supporting frame in each half-period of the oscillation is null to provide the advantage of automatic balancing of the supporting frame and reduction of the space occupied and construction and maintenance costs due to the smaller number of mechanical components employed in the system adopted.

* * * * *